US005840123A

United States Patent [19]

Holbrook

[11] Patent Number: 5,840,123

[45] Date of Patent: Nov. 24, 1998

[54] MAILING SYSTEM MOISTENER APPARATUS WITH RECIRCULATING EXCESS MOISTENING FLUID

[75] Inventor: Russell W. Holbrook, Middlebury, Conn.

[73] Assignee: Pitney Bowes Inc., Stamford, Conn.

[21] Appl. No.: 887,040

[22] Filed: May 22, 1992

[51] Int. Cl.[6] ..... B05C 11/00; B43M 3/00

[52] U.S. Cl. ..... 118/603; 156/441.5; 156/DIG. 35

[58] Field of Search ..... 118/603, 602; 156/441.5, DIG. 32, DIG. 35

[56] References Cited

U.S. PATENT DOCUMENTS

| | | | |
|---|---|---|---|
| 3,911,179 | 10/1975 | Goettsch | 118/603 X |
| 3,911,862 | 10/1975 | Lupkas | 118/7 |
| 3,981,270 | 9/1976 | Bogdanski | 118/257 |
| 3,991,709 | 11/1976 | Sato et al. | 118/603 X |
| 4,643,123 | 2/1987 | Auerbach | 118/32 |
| 4,670,144 | 6/1987 | McCausland et al. | 210/244 |
| 4,840,397 | 6/1989 | Katz et al. | 280/739 |
| 4,875,965 | 10/1989 | Marzullo | 156/441.5 X |
| 4,924,805 | 5/1990 | O'Dea | 118/680 |
| 5,006,233 | 4/1991 | Muisener | 210/96.1 |
| 5,006,240 | 4/1991 | Steffero, Sr. | 210/223 |
| 5,007,370 | 4/1991 | Dannatt | 118/246 |
| 5,013,432 | 5/1991 | Martinez-Mugica | 210/195.1 |
| 5,022,953 | 6/1991 | Fassman et al. | 156/441.5 |
| 5,034,123 | 7/1991 | Tanaka et al. | 210/195.1 |

*Primary Examiner*—David A. Simmons
*Assistant Examiner*—Paul M. Rivard
*Attorney, Agent, or Firm*—Steven J. Shapiro; Melvin J. Scolnick

[57] ABSTRACT

A moistening apparatus includes a moistening fluid supply means. A moistening means is connected to the moistening fluid supply means for applying the moistening fluid onto the glue line of an envelope flap or onto the glue area of a postage meter or parcel register tape. Excess moistening fluid collection means are positioned with respect to the moistening means such that excess moistening fluid collects in the excess moistening fluid collection means. The collected excess moistening fluid from the excess moistening fluid collection means is moved to the moistening fluid supply means. This recirculates excess moistening fluid back to the moistening fluid supply means.

9 Claims, 4 Drawing Sheets

MAILING SYSTEM MOISTENER APPARATUS WITH RECIRCULATING EXCESS MOISTENING FLUID

FIELD OF THE INVENTION

The present invention relates to moistening apparatus for mailing systems and, more particularly, to a mailing systems moistening apparatus which recirculates excess moistening fluid.

BACKGROUND OF THE INVENTION

Moistening apparatus are included in various mailing systems. The moistening apparatus may include a mechanism for moistening the glue line on flaps of envelopes in either a mailing machine or an inserter, and may also include a mailing machines mechanism for moistening postage meter or parcel register tapes. Moistening apparatus must work with a wide variety of glues, papers and envelope flap glue line profiles. Moreover, in the case of mailing machines and smaller inserters, these devices are often operated in offices or mail rooms. Accordingly, it is particularly desirable with mailing machines and small inserters that the equipment should be easy to operate, require a minimum of adjustments and require a minimum of service.

In prior mailing systems, a moistening fluid, such as water or water with a biocide, is applied, for example, to a pad, brush, or belt member. The glue line of an envelope flap or a meter or register tape is passed across this wetted member. The wetted member rubs across the glue to directly transfer moistening fluid and work the water into the glue to thereby activate the glue. This allows, as the case may be, sealing of the envelope flap or adherence of the meter or register tape to a mailpiece. Other flap moistening systems have been employed which involve spraying moistening fluid onto the glue line on the flaps of envelopes to thereby activate the glue.

Examples of mailing systems moistening apparatus are shown in: U.S. Pat. No. 5,022,953 issued Jun. 11, 1991 for MOISTURE APPLYING APPARATUS HAVING A REMOVABLE MOISTURE APPLICATOR, which utilizes a moisture applicator pad for moistening the glue; U.S. Pat. No. 5,007,370 issued Apr. 16, 1991 for MAILING MACHINE TAPE MODULE AND TAPE TAKE-UP AND MOISTENING SYSTEM THEREOF, which discloses a tape moistened by a roller having a resilient, sorbent felt material on its surface; U.S. Pat. No. 3,981,270 issued Sep. 21, 1976 for ENDLESS BELT ENVELOPE FLAP MOISTENING SYSTEM, which discloses the use of a fabric belt for moistening the glue region of an envelope flap passed by and in contact with the moistening belt; U.S. Pat. No. 4,643,123 issued Feb. 17, 1987 for ENVELOPE MOISTENING APPARATUS, which employs a applicator brush for moistening an envelope glue line; U.S. Pat. No. 4,924,805 issued May 15, 1990 for PUMP SYSTEM FOR MOISTENER NOZZLE, which discloses a non-contact spray moistening system to apply moistening fluid to an envelope flap along its glue line; and, U.S. Pat. No. 3,911,862 issued Oct. 14, 1979 for ENVELOPE FLAP MOISTENING APPARATUS, which discloses a moistening system wherein a pair fixed nozzles are aligned to selectively spray water against an envelope flap.

SUMMARY OF THE INVENTION

It has been discovered that in high speed mailing systems, excess moistening fluid can accumulate in the system during the moistening process. This is particularly the case in non-contact sealing systems. When water is sprayed onto the glue line of an envelope flap or onto a postage meter tape glue area, excess moistening fluid may drip-off the envelope flap or postage meter tape into the mailing system.

The present invention provides for the ability to moisten envelope flaps and/or postage meter or parcel register tapes to thereby activate the glue at high speed with more than sufficient fluid to moisten a range of envelope flap glue line profiles, glue compositions, and paper types.

The present invention also reduces the amount of user attention required to service the mailing system by reducing the frequency that the moistening fluid supply must be replenished and by also reducing the contamination of the moistening fluid used in the system.

In accordance with the present invention, a moistening apparatus includes a moistening fluid supply means. A moistening means is connected to the moistening fluid supply means for applying the moistening fluid onto the glue line of an envelope flap or onto the glue area of a postage meter or parcel register tape. Excess moistening fluid collection means are positioned with respect to the moistening means such that excess moistening fluid collects in the excess moistening fluid collection means. Means are provided for moving the collected excess moistening fluid from the excess moistening fluid collection means to the moistening fluid supply means. This recirculates excess moistening fluid back to the moistening fluid supply means.

BRIEF DESCRIPTION OF THE DRAWING

A complete understanding of the present invention may be obtained from the following detailed description of the preferred embodiment thereof, when taken in conjunction with the accompanying drawings, wherein like reference numerals designate similar elements in the various figures, and in which.

DETAILED DESCRIPTION OF THE PREFERRED EMBODIMENT

Figure 1:
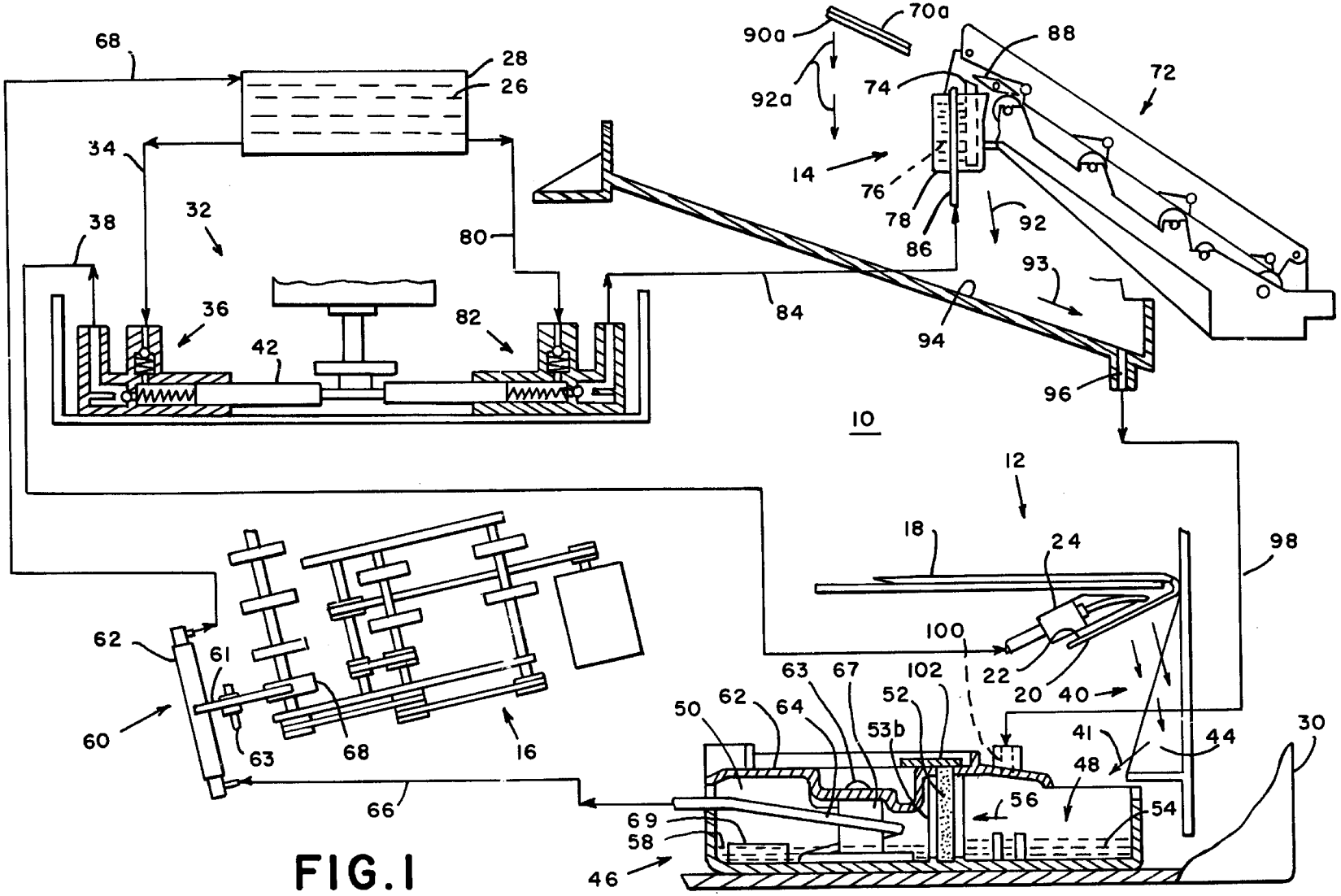
FIG. 1 is a diagrammatic view of a mailing system moistening apparatus embodying the present invention, with portions of the apparatus sectioned to show features of the apparatus.
Figure 3:
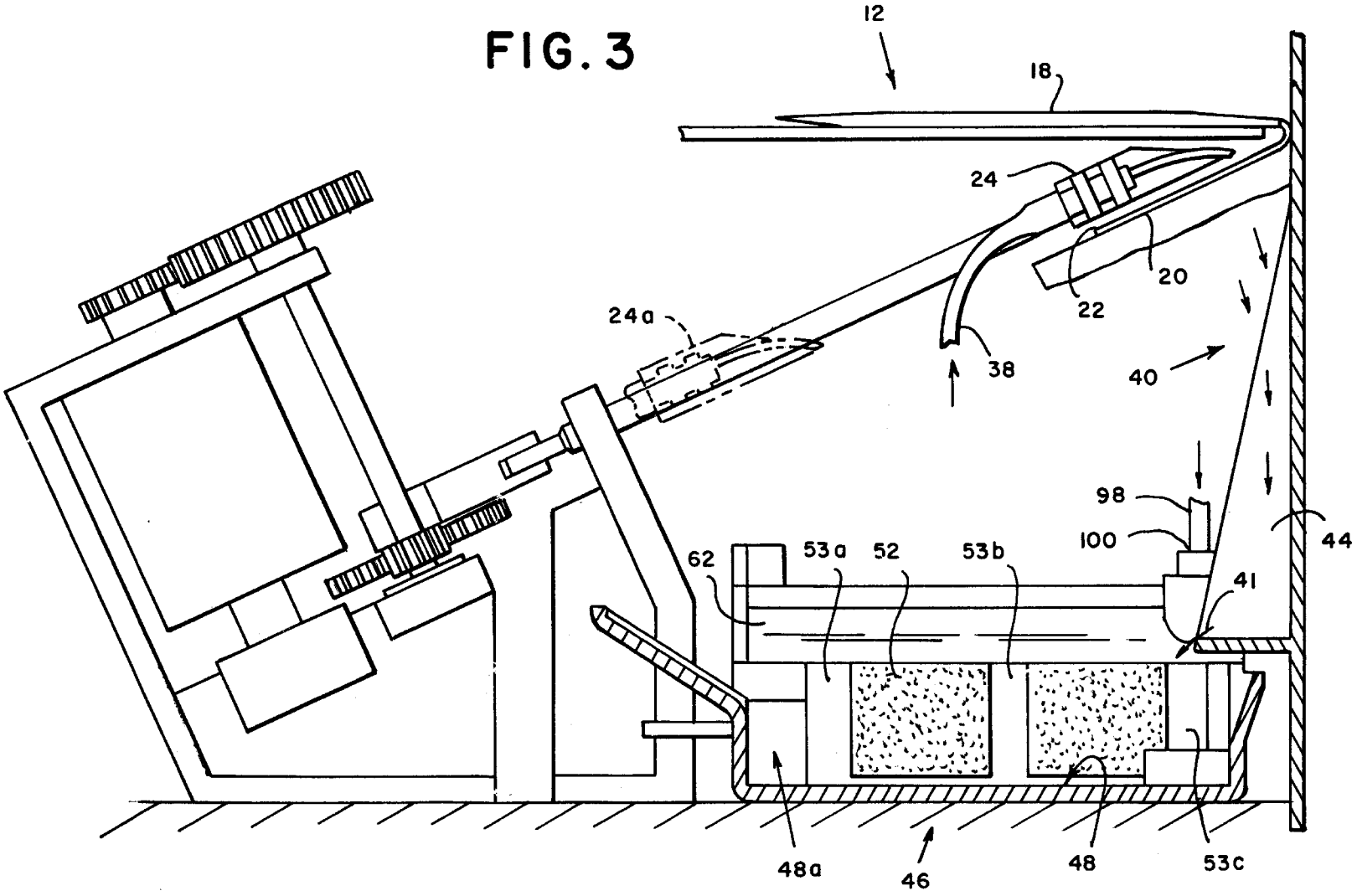
FIG. 3 is an enlarged view of the envelope flap glue line moistening mechanism, with the excess fluid collection tank shown in section taken along the lines A—A of FIG. 2 and rotated 90° with respect to the excess fluid collection tank shown in FIG. 1; and, FIG. 4 is an enlarged diagrammatic view, partially in section, of the postage meter tape portion of the moistening apparatus shown in FIG. 1.

Reference is now made to the figures, and specifically to FIG. 1. A mailing system 10, here a mailing machine, includes a moistening apparatus for moistening the glue line on the flaps of envelopes and for moistening a postage meter tape. The envelope glue line flap moistening structure is shown generally at 12 (with an enlarged view shown in FIG. 3) and the postage meter or parcel register tape glue moistening structure is shown generally at 14 (with an enlarged view shown in FIG. 4). The moistening apparatus includes a closed loop moistening fluid recovery system which recycles spillage and over sprayed or otherwise applied moistening fluid. It should be specifically noted that the present invention is useable in all forms of mailing systems, including inserters, envelope sealing systems and in other mailing and parcel delivery applications where flaps or mailpieces are to be sealed or where tapes are to be moistened.

A transport section 16 is provided in the mailing machine for transporting envelopes, not shown, to be presented to the flap moistening structure 12. Applicant hereby incorporates by reference U.S. Pat. No. 4,924,805 for PUMP SYSTEM FOR MOISTENER NOZZLE issued May 15, 1990 to Kevin J. O'Dea and assigned to Pitney Bowes Inc. The patent discloses the operation of portions of the envelope flap moistening structure including the transport and moveable flap moistening spray nozzle structure.

Referring to the envelope flap moistening area 12 of the mailing system 10, an envelope 18 includes a flap portion 20. The envelope flap includes a glue area 22 which is adapted to be activated with a moistening fluid such as water, or water with an appropriate biocide. The glue line 22 on flap 20 may follow a particular profile such as the contour of the edge of the envelope. It will be appreciated that the length of the envelope flap as well as the thickness and dimensions of the glue line as well as the glue composition and the envelope paper composition can vary widely.

The envelope flap moistening spray nozzle 24 is moveable (see FIG. 3 where the nozzle is shown in phantom in a second position 24*a*) to follow the glue line profile as the envelope passes underneath the moistening spray nozzle 24. Moistening fluid 26 from a suitable moistening fluid supply tank 28 is pumped to the spray nozzle 24. The supply tank 28 is dimensioned to provide a volume to contain a sufficient amount of moistening fluid for the particular application and, if required, may be suitably dimensioned and positioned to be within the mailing systems housing 30. The moistening fluid supply tank 28 may include a cover, not shown, to prevent the contamination of the moistening fluid in the supply tank from paper dust, and abraded materials within the mailing system housing 30 from, for example, worn rollers, transport belts and surfaces which come into contact with moving envelopes.

The moistening fluid is pumped to the spray nozzle by a pump shown generally at 32. The pump system, which is described in detail in the above-noted U.S. Pat. No. 4,924,805, and here incorporated by reference, pumps the moistening fluid 26 along the path 34, through the pump portion 36 path 38 to the non-contact spray nozzle 24. The nozzle 24 sprays the moistening fluid onto the glue line 22 of the envelope flap. Excess moistening fluid shown generally at 40 drips-off the envelope flap. This excess fluid, which for the purpose of this description includes over sprayed moistening fluid, is channeled in a manner which will be hereafter described.

The problem of excess moisture has been discovered to be an increasing phenomena as the rate of speed of the envelope passing the moistening section increases. Moreover, while contact moistening systems may have excess moistening fluid which is generated during the moistening process, it is desirable in non-contact moistening systems to ensure a more than ample quantity of water or moistening fluid is applied to the glue to be activated. This is because contact moistening systems have the added action rubbing a moisture applicator across the glue line which tends to work the moistening fluid into the glue through a friction contact. This action works the moistening fluid into the glue beneath the glue surface. For non-contact moistening systems, however, this is not the case.

It has been observed in non-contact sealing systems that in certain circumstances excess moistening fluid accumulation can be in the order of 8 fluid ounces for 10,000 sealed envelopes. This, of course, will vary depending on numerous factors such as envelope glue line length, quantity of moistening fluid applied, paper composition and glue composition. It is this excess moistening fluid which is recycled and does not have to be otherwise accommodated such as by the use of drains or evaporation tanks.

In non-contact moistening systems, it may be desirable to compensate for the absence of the working phenomena by having additional moistening fluid applied to the glue area. It may even become desirable to saturate the glue area with the maximum quantity of moistening fluid that could be applied depending on factors such as glue composition, paper composition, speed of the envelope, and the like. Thus, the quantity of moistening fluid applied by the spray from nozzle 24 to flap glue line 22, is controlled to provide sufficient fluid for satisfactory sealing. However, even in contact moistening systems, it may be desirable to increase the moistening fluid applied to activate the glue to enhance the sealing of envelope flaps or adherence of tapes to a mailpiece.

Control of the quantity of moistening fluid is achieved by controlling the length of the pump stroke of the pump stroke arm 42. When more moistening fluid is desired to be applied, a greater pump stroke is caused to occur. And, correspondingly, when less moistening fluid is desired to be applied, a shorter pump stroke is caused to occur by pump stroke arm 42.

Figure 2:
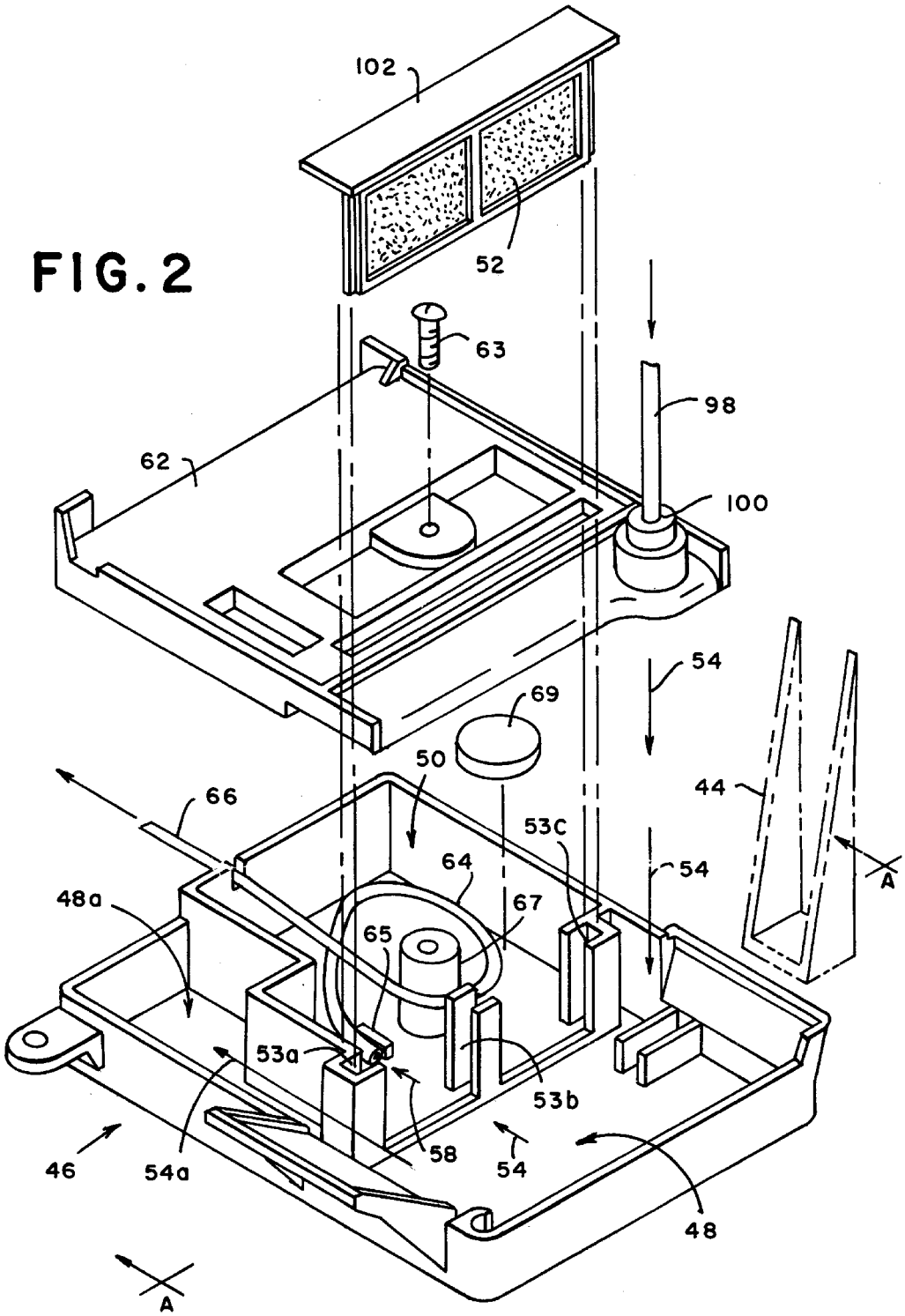
FIG. 2 is an exploded perspective view of the excess of moistening fluid collection tank shown in FIG. 1.

Reference is now made to FIG. 2 and the lower right portion of FIG. 1. Excess moistening fluid 40 as it leaves the flap moistening area 12 is channelled by baffles such as baffle 44 within the mailing system housing 30 to an excess moistening fluid collection tank shown general at 46. The excess moistening fluid tank 46 is comprised of a first section 48 into which excess moistening fluid 41 is diverted by baffle 44 and other inclined surfaces within the mailing system housing 30. A second moistening fluid tank section 50 is provided and is operatively connected to section 48 by a removable filter 52. The filter is held in its operative position by members 53*a*, 53*b* and 53*c* forming slots into which filter 52 is inserted. Excess moistening fluid 54 (shown in FIG. 1 only) is collected in section 48 and passes through filter 52 as shown by arrow 56 to enter and be stored in the second section 50. The filtered excess moistening fluid 58 (shown in FIG. 1 only) in section 50 of the excess moistening fluid tank 46 is thereafter moved by pump 60 back to the moistening fluid supply tank 28.

An overflow area 48*a* is provided to increase the fluid capacity of section 48. Excess moistening fluid 54*a* flows from section 48 into overflow area 48*a*. This excess moistening fluid 54*a* will, in due course, pass through the filter 52. This is due to the flow of fluid and the angling of the excess moistening fluid collection tank 46. The size and shape of the overflow area 48*a* is not critical and is dictated by the capacity, and available area in which it is to be physically mounted.

The filter 52 within the excess moistening fluid collection tank 46 may be fabricated from a nomex material such as felted aramid fibers, 22 oz/yd$^2$ or a mesh material such as nylon (285 micron). One suitable filter had a dimension of 1"×3"×0.25" and was fabricated from nomex. It should be expressly noted that the particular filter material is not essential to the particular invention to the present invention. The filter can be fabricated from any suitable material which is able to filter contaminates from the moistening fluid in excess moistening fluid collection section 48 and enable the flow of sufficient excess moistening fluid to section 50. The filter 52 may be conveniently removed by a handle shown at 102 to facilitate ease of replacement. While the moistening fluid 54 within section 48 may be caused to move by wicking action through the filter 52 and into the section 50, the excess moistening fluid tank 46 may be angled to assist in the flow of contaminated fluid to the filter and thereafter through the filter into the sealed excess moistening fluid collection section 50. It should be noted that the filter 52 can be placed in other locations in the flow path for the moistening fluid such as in path 68.

The moistening tank 46 includes a cover 62 for completely enclosing the second section 50 of the excess fluid moistening tank 46 and a portion of the first section 48. This cover, which is secured in its operative position by a screw 63, is provided to prevent, as in the case of moistening fluid supply tank 28, paper dust and other material from contaminating the filtered excess moistening fluid 58 contained in section 50. The excess moistening fluid 58 is pumped by pump 60 from section 50 through the tube 64 within the section 50, along path 66, through pump 60, along path 68 and into the moistening fluid supply tank 28.

The tube 64 is secured within the section 50 by a tab 65 to clamp the tube end in an appropriate position at the bottom of section 50. The tube 64 is wrapped around post 67 to prevent the tube from being accidentally pulled out of the section 50. Moistening fluid, specifically, the excess portion of the moistening fluid, is recirculated back to the moistening fluid supply tank 28. In this manner, excess moistening fluid from the envelope flap moistening structure 12 is not permitted to accumulate in areas within the mailing system housing 30 to which it might flow, but is collected, filtered, and moved back to the tank 28. This ensures that a moisture accumulation does not occur within the mailing system and that the excess moistening fluid is recirculated for use by the moistening apparatus. Accordingly, the frequency with which the moistening fluid supply tank 28 needs servicing by being refilled with moistening fluid due to envelope flap sealing or, as will later be explained, for tape moistening is reduced. Moreover, the potential problem of contaminated moistening fluid being recirculated into the tank is eliminated as well as other problems which could be experienced with moistening fluid accumulating within the housing 30.

A biocide tablet 69 is provided and secured within the section 50. The biocide tablet 69 is, for example, Lonza Corporation Dantochlor RW will work however, it is not potable, therefore, could not be used in this application. The biocide table slowly releases a biocide agent into the filtered excess moistening fluid in section 50. The biocide prevents the growth of fungus in the moistening fluid.

For high speed, non-contact sealing, (one to four envelopes per second) it has observed that the moistening fluid dripping off the envelope flap glue line is not generally contaminated with glue. This is because in this time period the glue usually will not activate and dissolve into the excess moistening fluid. Thus, the nature of the filtering and the type of biocide (if any) employed may be affected by the applicator apparatus, employed (spray or contact) the speed of the system, the glue composition and other factors which will determine the extent to which excess moistening fluid dripping off the envelope flap glue line will be contaminated.

The pump structure 60 is similar to supply pump described in U.S. Pat. No. 5,186,101, issued on Feb. 16, 1993 for INK REPLENISHING SYSTEM in the names of Charles F. Murphy, III and Patrick Murphy, and assigned to Pitney Bowes, Inc. The disclosure of this INK REPLENISHING SYSTEM patent is hereby incorporated by reference. The pump 60 includes, as is explained in greater detail in the patent, a deformable tubular member 62. As is shown in FIG. 1, a finger 61 is caused to rotate about a pivot 63 by action of an eccentric cam surface 68 which is part of the envelope transport system 16.

Figure 4:
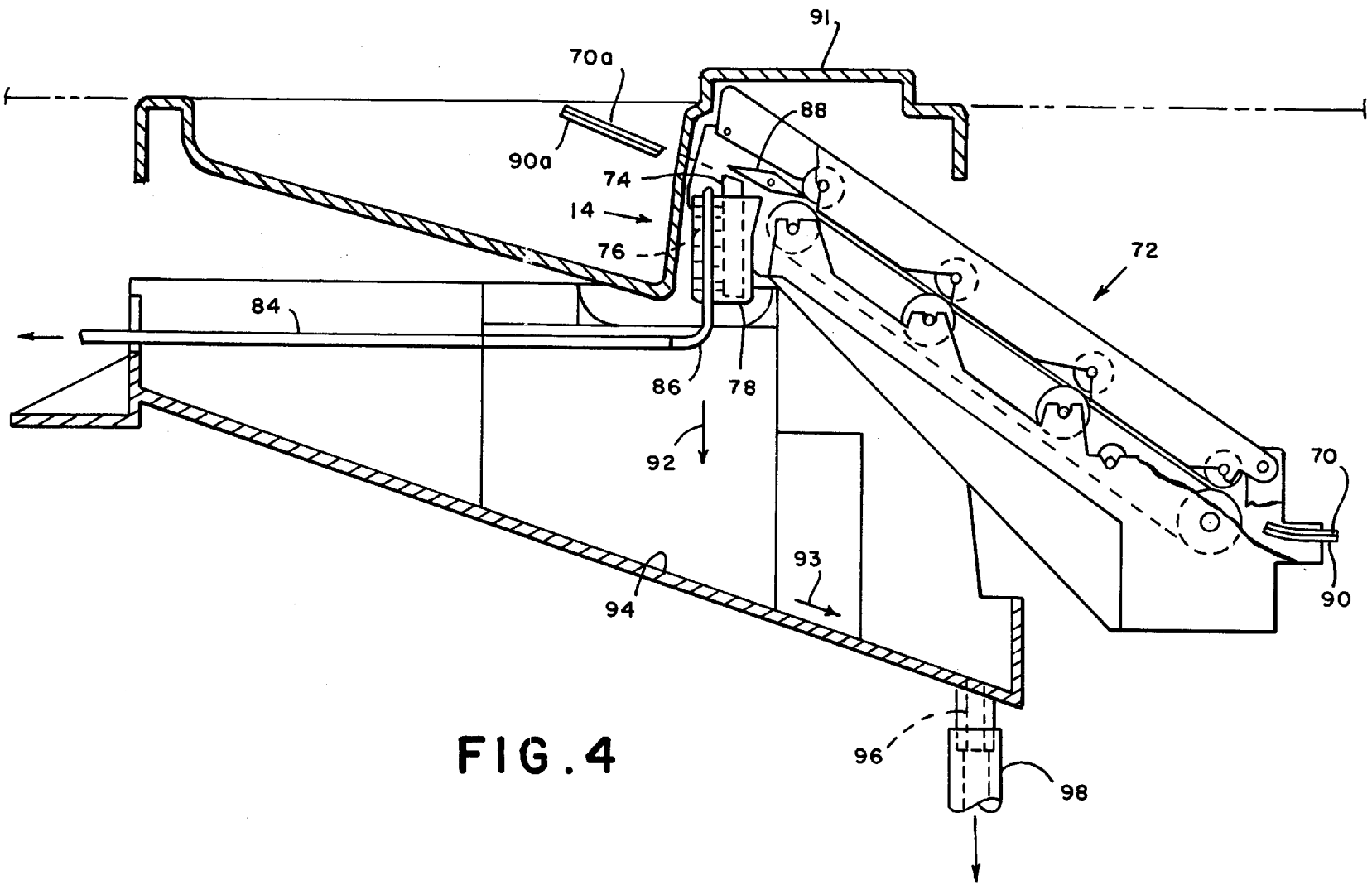

Referring now to the postage meter tape moistening structure 14 (shown in both the upper right portion of FIG. 1 and in FIG. 4) of the mailing system 10, a tape 70, such as a postage meter tape or a parcel register tape, is driven by the tape drive system 72 to pass across a moistening applicator pad 74. A portion of moistening applicator pad 74 is submerged in the moistening fluid 76 in a postage meter tape moistening fluid housing or tank 78. Moistening fluid 26 in the moistening fluid supply tank 28 is pumped by pump 32 from the supply tank 28 along a path 80 through pump portion 82 and a path 84 into the tube 86 within the tape moistening fluid housing 78. A movable deflector blade 88 can be positioned to deflect the tape 70 to either pass in operative engagement with the tape moistening applicator pad 74 so that the glue area 90 on the tape is caused to be moistened or to pass out of contact with the moistening applicator pad 74 so that a non-moistened tape is delivered to a user. The tape moistening structure 14 is protected by a pivotably mounted cover 91, a portion of which is shown in FIG. 4. The cover when pivoted from the position shown provides access to the tape moistening fluid housing 78.

Excess moistening fluid 92 from the tape moistening structure 14 is channeled by a baffle 94 such that excess moistening fluid, such as that shown at 93, is caused to pass through the opening 96 in the baffle 94. The excess moistening fluid flows by gravity feed along a path 98 into an opening 100 in the top of the first section 48 of the excess moistening fluid collection tank 46. The excess moistening fluid flows through the cover 62 into the first section to become part of the excess moistening fluid 54 within the section 48.

It should be noted that excess moistening fluid may come from the moistening tape moistening area 14 either due to a spillage from the tank such as may occur during cleaning of the tank 78 or due to excess moistening fluid which may drip-off the tape such as excess moistening fluid 92*a* (FIG. 1) coming from tape glue area 90*a*.

While the invention has been disclosed and described with reference to the particular embodiment described in the preceding detailed description of the preferred embodiment, it will be clearly apparent, that variations and modifications may be made to the preferred embodiment. For example, any number of fluid pumps may be substituted for the particular pumps disclosed herein. Or, as yet another example, different envelope flap or tape moistening mechanisms can be substituted for those described herein. As a further example, the various tanks, the excess moistening fluid collection tank 46 and the associated filter 50, the moistening fluid supply tank 28, tape moistening tank 78, can be of any suitable size, shape or construction so long as they provide the necessary functionality. This, of course, would be the same for various baffles or surfaces within the mailing system housing 30 which guide the flow of moistening fluid. Thus, it is intended in the following claims to cover each variation and modification as falls within the true spirit and scope of the present invention.

What is claimed is:

1. An improved moistening apparatus for moistening the glue line of an envelope flap, said glue line being along the edge of the envelope and having a generally uniform cross-sectional width, comprising:

support means for causing said envelope flap to be partially open and for causing said envelope to travel in a first direction;

a nozzle applicator slidably mounted to said support means for slidable displacement of said nozzle in a second direction generally perpendicular to said first direction and further mounted such that said nozzle is between said envelope and said envelope flap;

pump means for causing moistening fluid to be delivered to and through said nozzle; and, control means for causing said pump to deliver a given volume of moistening fluid to said nozzle and for causing said nozzle to displace in said second direction such that said nozzle is opposite said glue line of said envelope as said envelope is displaced in said first direction further such that said moistening fluid is applied by said nozzle evenly to said glue line;

wherein the improvement comprises:

a moistening fluid supply tank for containing said moistening fluid;

said pump means having means for obtaining said moistening fluid from said moistening fluid supply tank;

excess moistening fluid collection means including:

a baffle extending in said second direction throughout the displacement range of said nozzle such that said envelope flap is between said nozzle and said baffle;

an excess moistening fluid collection tank positioned with respect to said baffle for collecting excess moistening fluid deposited on said baffle; and said pump means having means for pumping said collected moistening fluid from said excess moistening fluid collection means to said moistening fluid supply tank;

wherein said excess moistening fluid collection tank comprises a first section for accumulating excess moistening fluid from said nozzle and a second section, said second section connected to said moistening fluid supply tank to enable excess moistening fluid from said second section to be pumped into said moistening fluid supply tank.

2. An improved moistening apparatus as defined in claim 1 including filter means connected between said excess moistening fluid collection tank first and second sections such that said moistening fluid passing from said first section to said second section is filtered by said filtering means.

3. An improved moistening apparatus as defined in claim 2 wherein said filter means is removably connected between said first and second sections of said excess moistening fluid collection means.

4. An improved moistening apparatus as defined in claim 2 wherein said filter means is fabricated from a felted aramid fiber.

5. An improved moistening apparatus as defined in claim 2 wherein said filter is fabricated from nylon mesh.

6. An improved moistening apparatus for moistening the glue line of an envelope flap, said glue line being along the edge of the envelope and having a generally uniform cross-sectional width, comprising:

support means for causing said envelope flap to be partially open and for causing said envelope to travel in a first direction;

a nozzle applicator slidably mounted to said support means for slidable displacement of said nozzle in a second direction generally perpendicular to said first direction and further mounted such that said nozzle is between said envelope and said envelope flap;

pump means for causing moistening fluid to be delivered to and through said nozzle; and, control means for causing said pump to deliver a given volume of moistening fluid to said nozzle and for causing said nozzle to displace in said second direction such that said nozzle is opposite said glue line of said envelope as said envelope is displaced in said first direction further such that said moistening fluid is applied by said nozzle evenly to said glue line;

wherein the improvement comprises:

a moistening fluid supply tank for containing said moistening fluid;

means for moistening tapes, said tape moistening means including a tape moistening fluid tank connected to said moistening fluid supply tank;

said pump means having means for obtaining said moistening fluid from said moistening fluid supply tank;

excess moistening fluid collection means including:

a baffle extending in said second direction throughout the displacement range of said nozzle such that said envelope flap is between said nozzle and said baffle;

an excess moistening fluid collection tank positioned with respect to said baffle for collecting excess moistening fluid deposited on said baffle;

said pump means having means for pumping said collected moistening fluid from said excess moistening fluid collection means to said moistening fluid supply tank.

7. A improved moistening apparatus as defined in claim 1 further comprising a mailing system housing and wherein said excess moistening fluid collection means is mounted within said mailing system housing and said second section is enclosed to prevent contamination of excess moistening fluid in said second section.

8. An improved moistening apparatus for moistening the glue line of an envelope flap, said glue line being along the edge of the envelope and having a generally uniform cross-sectional width, comprising:

support means for causing said envelope flap to be partially open and for causing said envelope to travel in a first direction;

a nozzle applicator slidably mounted to said support means for slidable displacement of said nozzle in a second direction generally perpendicular to said first direction and further mounted such that said nozzle is between said envelope and said envelope flap;

pump means for causing moistening fluid to be delivered to and through said nozzle; and, control means for causing said pump to deliver a given volume of moistening fluid to said nozzle and for causing said nozzle to displace in said second direction such that said nozzle is opposite said glue line of said envelope as said envelope is displaced in said first direction further such that said moistening fluid is applied by said nozzle evenly to said glue line;

wherein the improvement comprises:

a moistening fluid supply tank for containing said moistening fluid;

said pump means having means for obtaining said moistening fluid from said moistening fluid supply tank;

excess moistening fluid collection means including:

a baffle extending in said second direction throughout the displacement range of said nozzle such that said envelope flap is between said nozzle and said baffle;

an excess moistening fluid collection tank positioned with respect to said baffle for collecting excess moistening fluid deposited on said baffle; and filter means operatively connected between said excess moistening fluid collection means and said moistening fluid supply tank;

said pump means having means for pumping said collected moistening fluid from said excess moistening fluid collection means to said moistening fluid supply tank.

9. In a mailing system, a moistening apparatus for moistening the glue line of an envelope flap, said glue line being along the edge of the envelope and having a generally uniform cross-sectional width, said apparatus comprising:

support means for causing said envelope flap to be partially open and for causing said envelope to travel in a first direction;

a nozzle applicator slidably mounted to said support means for slidable displacement of said nozzle in a second direction generally perpendicular to said first direction and further mounted such that said nozzle is between said envelope and said envelope flap;

a moistening fluid supply tank for containing moistening fluid;

pump means for causing moistening fluid to be delivered to and through said nozzle, said pump means having means for obtaining said moistening fluid from said moistening fluid supply tank;

control means for causing said pump to deliver a given volume of moistening fluid to said nozzle and for causing said nozzle to displace in said second direction such that said nozzle is opposite said glue line of said envelope as said envelope is displaced in said first direction further such that said moistening fluid is applied by said nozzle evenly to said glue line;

excess moistening fluid collection means including a baffle extending in said second direction throughout the displacement range of said nozzle such that said envelope flap is between said nozzle and said baffle whereby said baffle collects excess moistening fluid from said envelope flap;

an excess moistening fluid collection tank positioned with respect to said baffle for collecting said excess moistening fluid deposited on said baffle; and a tape moistening applicator which applies moistening fluid to a tape, said tape moistening applicator including a tape moistening fluid tank connected to said moistening fluid supply tank;

wherein said excess moistening fluid collection means further comprises a guide surface including an opening therein which is mounted beneath said tape moistening applicator such that excess moistening fluid from said tape collects on said guide surface and passes through said opening, and means for connecting said opening to said excess moistening fluid collection tank such that said excess moistening fluid from said tape flows into said excess moistening fluid collection tank;

wherein said pump means includes means for pumping said collected moistening fluid from said excess moistening fluid collection means to said moistening fluid supply tank.

* * * * *